US010779364B2

(12) United States Patent
Kitano et al.

(10) Patent No.: US 10,779,364 B2
(45) Date of Patent: Sep. 15, 2020

(54) INDUCTION HEATED ROLL APPARATUS

(71) Applicant: TOKUDEN CO., LTD., Kyoto-shi, Kyoto (JP)

(72) Inventors: Takatsugu Kitano, Otsu (JP); Toru Tonomura, Otsu (JP); Mamoru Watanabe, Tsu (JP)

(73) Assignee: TOKUDEN CO., LTD., Kyoto-Shi, Kyoto (JP)

( * ) Notice: Subject to any disclaimer, the term of this patent is extended or adjusted under 35 U.S.C. 154(b) by 96 days.

(21) Appl. No.: 15/894,547

(22) Filed: Feb. 12, 2018

(65) Prior Publication Data

US 2018/0235036 A1 Aug. 16, 2018

(30) Foreign Application Priority Data

Feb. 13, 2017 (JP) ..... 2017-024436
Nov. 9, 2017 (JP) ..... 2017-216668
Jan. 24, 2018 (JP) ..... 2018-009310

(51) Int. Cl.
*H05B 6/14* (2006.01)
*B21B 27/08* (2006.01)

(52) U.S. Cl.
CPC ..... *H05B 6/145* (2013.01); *B21B 2027/086* (2013.01)

(58) Field of Classification Search
CPC ... H05B 6/145; B21B 27/06; B21B 2027/086; B21B 27/106
See application file for complete search history.

(56) References Cited

U.S. PATENT DOCUMENTS 6,111,235 A * 8/2000 Ritter ..... D02J 1/22 219/619
6,848,357 B2 * 2/2005 Linnonmaa ..... D21G 1/0293 100/308
2005/0255396 A1 * 11/2005 Kitano ..... F28D 15/02 219/619

FOREIGN PATENT DOCUMENTS

DE 19854499 A1 6/1999
DE 102012206798 A1 11/2012
(Continued)

OTHER PUBLICATIONS

Machine Translation of German Patent Publication No. DE 10 2012206798 A1 (Year: 2012).*
(Continued)

*Primary Examiner* — Christopher J Besler
(74) *Attorney, Agent, or Firm* — Alleman Hall Creasman & Tuttle LLP

(57) ABSTRACT

The present invention uniformly cools a roll body and/or an induction heating mechanism by gas without complicating the configuration around the roll body. An induction heated roll apparatus includes a roll body having a hollow part, an induction heating mechanism disposed in the hollow part to subject the roll body to induction heating, and a cooling mechanism to cool the roll body and/or the induction heating mechanism by generating a gas flow in a clearance between the roll body and the induction heating mechanism. The cooling mechanism includes a suction port disposed on one axial end side of the roll body that communicates with the clearance, an exhaust port disposed on an opposite axial end side of the roll body that communicates with the clearance, and a suction mechanism coupled to the exhaust port that sucks the gas in the clearance from the exhaust port.

19 Claims, 18 Drawing Sheets

(56) References Cited

FOREIGN PATENT DOCUMENTS

| | | | |
|---|---|---|---|
| EP | 2975907 | A1 | 1/2016 |
| JP | 2010017943 | A | 1/2010 |

OTHER PUBLICATIONS

European Patent Office, European Search Report Issued in Application No. 18156112.7, dated Jul. 12, 2018, Germany, 6 pages.

* cited by examiner

INDUCTION HEATED ROLL APPARATUS

BACKGROUND OF THE INVENTION

Field of the Invention

The present invention relates to an induction heated roll apparatus.

Background Art

An induction heated roll apparatus is used in, for example, a continuous heat treatment process of continuous materials, for example, sheet materials or web materials, such as plastic films, papers, fabrics, non-woven fabrics, synthetic fibers, and metal foils, as well as wire rods (yarn materials). The induction heated roll apparatus includes an induction heating mechanism disposed inside a roll body that rotates. The induction heating mechanism causes a circumferential wall part of the roll body to generate heat by an induced current.

Recently, there has been a demand for making a change to a heating temperature by the roll body in a short time in association with a change in, for example, continuous material type. After termination of the heat treatment process, an operator needs to stay at a site unless the temperature of the roll body lowers to a certain temperature or below from the viewpoint of safety and sanitation. It is thus necessary to cool the roll body in a short time as much as possible.

Examples of roll apparatuses designed to cool the roll body include an air cooling type one disclosed in Patent Document 1 which is designed to cool the roll body by supplying air to a clearance part between the roll body and the induction heating mechanism. Specifically, this roll apparatus includes an air supply pipe coupled to one end of the roll body, and an air exhaust pipe coupled to an opposite end of the roll body. A blower for supplying air to the clearance part is coupled to the air supply pipe.

With the above configuration, however, air is simply supplied from one end portion of the roll body by the blower, and the air warmed in the clearance part is not positively exhausted at the other end portion side of the roll body. This may lead to the problem of uneven cooling in the roll body.

Although a method for water cooling the roll body by supplying water and mist into the interior of the roll body has also been conceived, the cost of installing a water supply circuit is expensive. Upon occurrence of a water leak or the like, dielectric breakdown may lead to an accident.

PRIOR ART DOCUMENT

Patent Document

Patent Document 1: Japanese Unexamined Patent Publication No. 2010-17943

SUMMARY OF THE INVENTION

Problems to Be Solved By the Invention

Accordingly, the present invention has been made to solve the above issues, and has for its main object to make it possible to uniformly cool the roll body and/or the induction heating mechanism by gas.

Means of Solving the Problems

Specifically, an induction heated roll apparatus of the present invention includes a roll body, an induction heating mechanism, and a cooling mechanism. The roll body has a hollow part. The induction heating mechanism is disposed in the hollow part and designed to cause the roll body to be subjected to induction heating. The cooling mechanism is designed to cool the roll body and/or the induction heating mechanism by generating a gas flow in a clearance part between the roll body and the induction heating mechanism. The cooling mechanism includes a suction port, an exhaust port, and a suction mechanism. The suction port is disposed on one axial end side of the roll body and designed to communicate with the clearance part. The exhaust port is disposed on an opposite axial end side of the roll body and designed to communicate with the clearance part. The suction mechanism is coupled to the exhaust port and designed to suck gas in the clearance part from the exhaust port.

With the above configuration, an external gas is sucked from the suction port disposed on the one axial end side of the roll body, and the external gas flows through the clearance part between the roll body and the induction heating mechanism by coupling the suction mechanism to the exhaust port disposed on the opposite axial end side of the roll body, and then sucking the gas from the exhaust port. Here, the clearance between the roll body and the induction heating mechanism has an approximately cylindrical shape, and the external gas sucked from the suction port flows uniformly in the circumferential direction, thus making it possible to uniformly cool the roll body and/or the induction heating mechanism. Here, since the gas warmed by flowing through the clearance part is actively sucked by the suction port and exhausted, the roll body and/or the induction heating mechanism can be cooled more evenly. Additionally, a circumferential structure of the roll body intended for obtaining a main effect of uniformly cooling the roll body needs only to dispose the suction mechanism on the opposite axial end side of the roll body, thereby avoiding complication of the circumferential structure of the roll body.

Besides the above, the high-temperature gas may be exhausted to an appropriate place, such as outdoors, so that no high-temperature gas is exhausted into the installation space for the roll body by, for example, disposing an exhaust duct in the suction mechanism. This not only prevents the high-temperature gas from threatening the safety of an operator, but also prevents adverse effects on the continuous heat treatment process of a continuous material.

The roll body includes a cylindrical shaped shell part having a pair of axial ends, and a pair of journal parts respectively coupled to both axial ends of the shell part. The gas flowing through the clearance part preferably flows at a uniform flow velocity in the circumferential direction in order to obtain the effect of cooling the roll body or the like and circumferential temperature uniformity of the roll body.

For this purpose, a plurality of the suction ports are preferably disposed at the journal part on the one axial end side. By disposing the plurality of suction ports, it is possible to ensure mechanical strength of the journal parts and also uniformly suck the gas in the circumferential direction of the clearance part while reducing suction resistance.

In order to make the gas flow velocity in the clearance part more uniform in the circumferential direction, the suction ports are preferably disposed at equal intervals in the circumferential direction at the journal part on the one axial end side.

Entry of foreign matter into the roll body from the suction port can cause, for example, the problem that the induction coil of the induction heating mechanism is broken. In order to suitably solve the problem, the suction port is preferably provided with a filter for removing foreign matter in the gas to be sucked. An aperture ratio (or opening) is variously settable according to dust that can occur around the roll body. When the filter has a small aperture ratio, the suction resistance may increase. Therefore, suction performance of the suction mechanism needs to be enhanced to obtain a desired flow velocity by way of, for example, using a high-pressure suction device.

The exhaust port is disposed on the roll body side and is therefore rotated, whereas the suction mechanism is disposed on a stationary side and is therefore not rotated. As a specific embodiment for sucking the gas in the clearance part from the exhaust port being rotated, it is conceivable that the suction mechanism includes a stationary body disposed on the stationary side so as to cover the exhaust port, and a suction device coupled to the stationary body and designed to suck the gas in the clearance part from the exhaust port. Here, the stationary body may be a component dedicated to the suction mechanism. When the roll body is provided with a rotary transformer for a temperature detection device, the stationary body may be a stator housing to hold a stator of the rotary transformer or may be formed integrally with the stator housing.

In the configuration that the roll body includes a pair of axial ends and a pair of drive shafts respectively disposed at both axial ends, it is conceivable to dispose the exhaust port on an outer circumferential surface of the drive shaft on the opposite axial end side in order to increase a contact area between the gas flowing through the clearance part and an inner surface of the shell part of the roll body as much as possible. In this configuration, it is conceivable to dispose the stationary body on the drive shaft so as to cover the exhaust port by interposing therebetween two bearings disposed so as to hold the exhaust port therebetween.

The induction heating mechanism includes an induction coil and a support shaft to support the induction coil. The support shaft is supported from the inside of the roll body with a bearing interposed therebetween. If the bearing is subjected to high temperature, grease deterioration is accelerated, and damage may occur early. The damage to the bearing becomes a factor of corotation of the induction coil and the roll body, and there is a risk of a serious electrical accident.

In order to suitably solve the above problem by eliminating the bearing that can be subjected to the high temperature gas on the exhaust side, one axial end of the support shaft is preferably supported on the roll body with a bearing interposed therebetween, and an opposite axial end of the support shaft is preferably supported on a member disposed on a stationary side (for example, a support shaft block).

In this configuration, it is necessary to dispose a rotary seal in order that no external gas is sucked from a clearance between the drive shaft of the journal part and the support shaft in the roll body on the opposite axial end side.

In the configuration that the support shaft is supported through a bearing on each of both axial end sides of the roll body, the bearing disposed on the opposite axial end side of the roll body is preferably disposed axially further outside than the exhaust port.

With this configuration, the bearing on the opposite axial end side is located axially further outside than the exhaust port, and it is therefore possible to prevent the bearing from being positively subjected to the high-temperature gas, and the lifetime of the bearing is less likely to become shorter. It is also possible to prevent the external gas from being sucked from the bearing, and also prevent the bearing from reaching high temperatures by increasing ventilation resistance in such a manner that a shielding structure, such as a shielding plate, is disposed between the bearing on the opposite axial end side and the exhaust port.

In order to simplify the structure of the opposite axial end side of the roll body, the stationary body is preferably designed to support the opposite axial end side of the support shaft.

In order to simplify the structure of the suction mechanism, the suction device is preferably integrally disposed on the stationary body with no piping interposed therebetween.

It is conceivable to employ, as the suction device, electric ones, such as a motor fan and a blower. Meanwhile, when a compressed gas source exists at an installation location of the induction heated roll apparatus in a factory or the like, it is possible to use, as the suction device, a gas flow amplifier designed to suck the gas from the exhaust port by being supplied with a compressed gas from the compressed gas source.

When the induction heated roll apparatus is installed in an atmosphere containing a corrosive gas and a combustible gas, a serious accident may occur due to the fact that the corrosive gas or the combustible gas is sucked into the roll body. In order to suitably solve this problem, the induction heated roll apparatus preferably further includes a supply mechanism designed to supply the gas to the suction port. The supply mechanism preferably includes supply piping to supply the gas to the suction port, and a joint member to connect the supply piping and the suction port.

The gas exhausted from the exhaust port by the suction device has a high temperature, and the high-temperature gas is then exhausted outside. This may induce the problem of thermal effects on the surrounding environment. It is therefore preferable to further include a circulating passage designed to permit communication between the suction port and the exhaust port outside of the roll body so as to return the gas sucked from the exhaust port by the suction device to the suction port, and a heat exchanger disposed in the circulating passage and designed to cool the gas. This configuration contributes to reducing the influence of suction and exhaust.

The cooling of the roll body or the like is intended to, for example, quickly lower the temperature to a safe temperature after termination of an operation, quickly lower the temperature when changing settings to a lower operating temperature in association with a change in production type, or quickly lower the temperature when replacing with another roll body having a different function. In these cases, no load operation is basically carried out.

Meanwhile, a load (heat treated object) to be taken into the roll body has a high temperature. Accordingly, due to heat input from the load to the roll body, the temperature of the roll body may gradually increase even when an electrical input is discontinued. In such a case, there is a temperature control method for stably controlling the temperature at a predetermined temperature by carrying out heat extraction slightly exceeding the heat input of the load, and then inputting induction heating, which corresponds to an excess thereof. This type of operation needs cooling during the load operation, thus necessitating temperature uniformity in the axial direction of the roll body during the cooling. Therefore, the roll body preferably includes a jacket chamber enclosing a two-phase gas-liquid heating medium therein and extending in the axial direction.

An amount of heat needed for cooling and time needed for cooling in the roll body bear a proportionate relationship to a flow velocity, namely, flow rate of the gas. In other words, when the flow rate of the gas in the clearance part is increased, the amount of heat needed for cooling is increased to reduce the time needed for cooling. However, during the load operation, the necessary amount of cooling differs depending on the amount of heat of load and operation conditions. Accordingly, the cooling mechanism is preferably designed to adjust the flow rate of the gas flowing through the clearance part. This configuration makes it possible to efficiently adjust to a predetermined temperature of the roll body.

The gas flows along the outer circumferential surface of the induction coil in the induction heating mechanism by the cooling mechanism, and thus insulation deterioration can occur due to entry of moisture or a contaminant. Therefore, the outer circumferential surface of the induction coil of the induction heating mechanism is preferably coated with an insulating varnish, such as a polyimide-based, silicone-based, or epoxy-based one. A selectable insulating varnish is one which is durable against a maximum temperature that the induction coil reaches.

Contact between the induction heating mechanism and the roll body may induce a ground fault, thus necessitating a certain clearance therebetween. In order to improve the cooling effect by reducing the clearance part between the roll body and the induction heating mechanism so as to increase the flow velocity of air flow, an insulating pipe being smaller than an inner circumferential diameter of the roll body is preferably secured to an outer circumference of the induction heating mechanism, and the clearance part is preferably formed between the roll body and the insulating pipe. Even when the insulating pipe and the roll body come in contact with each other, the contact is less likely to cause a serious accident because the insulating pipe is thus disposed.

When moisture is attached to the inner surface of the roll body, rust can occur, thus leading to insulation deterioration. Therefore, the inner surface of the roll body is preferably coated with an antirust material (for example, hard chromium plating, nickel plating, or an antirust paint, such as Stainless Coat (product name)).

In order to increase the cooling effect by increasing a heat transfer area of the inner surface of the roll body, a rugged structure is preferably formed on the inner surface of the roll body. Because the inner surface of the roll body serves as a heat generation part due to induction heating, the inner surface is preferably made into a regular shape in the circumferential and axial directions from the viewpoint of equalizing the amount of heat generation.

Effects of the Invention

With the present invention thus configured, it is possible to uniformly cool the roll body and/or the induction heating mechanism by the gas.

DESCRIPTION OF THE EMBODIMENTS

First Embodiment

An induction heated roll apparatus 100 in a first embodiment is intended to be used in, for example, a continuous heat treatment process of a continuous material, for example, sheet materials or web materials, such as plastic films, papers, fabrics, unwoven fabrics, and metal foils, as well as wire rods (yarn materials).

Figure 1:
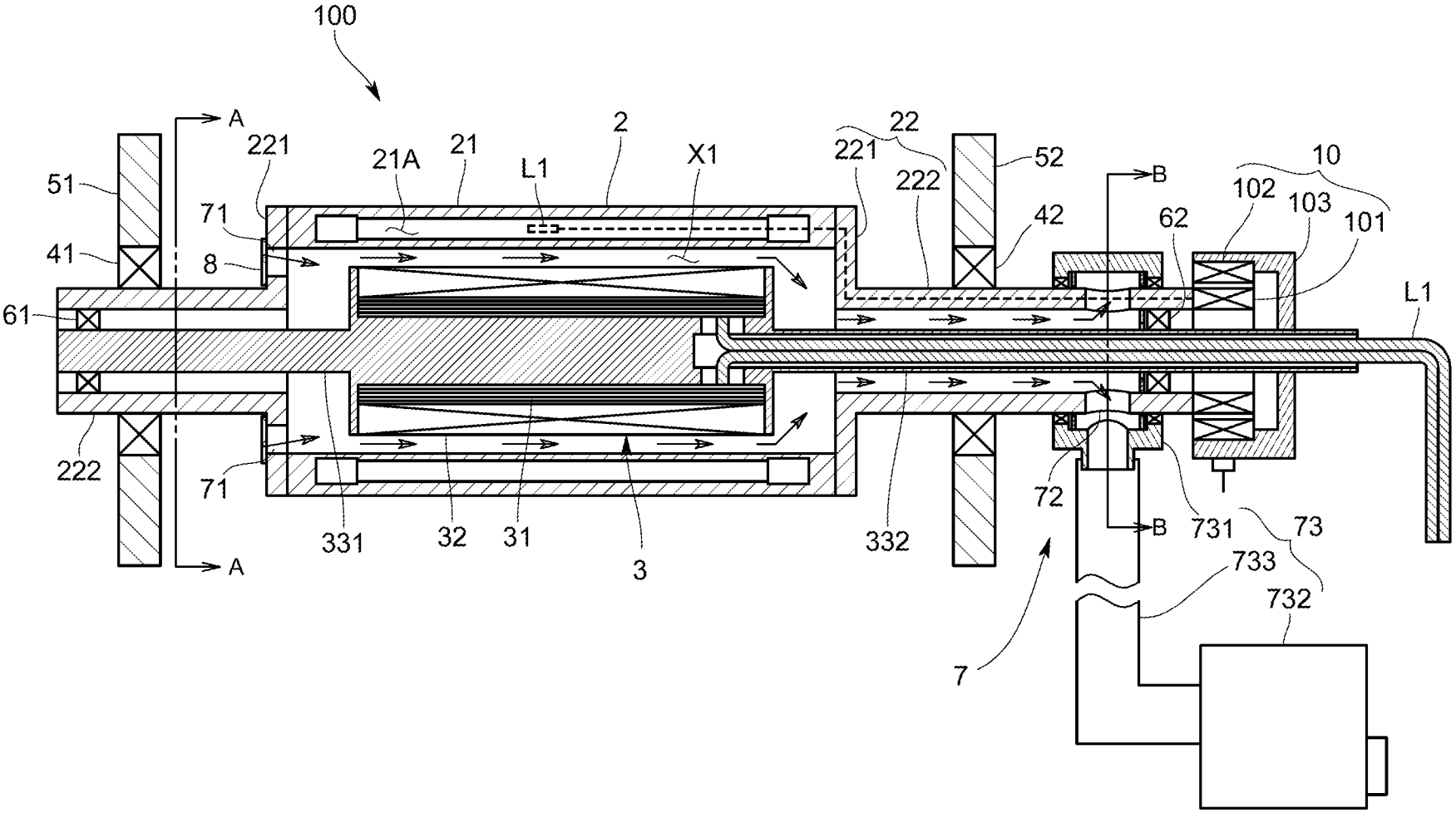
FIG. 1 is a sectional view schematically illustrating a configuration of an induction heated roll apparatus in a first embodiment.

Specifically, as illustrated in FIG. 1, the induction heated roll apparatus 100 includes a hollow cylindrical roll body 2 being rotatably supported, and an induction heating mechanism 3 disposed in a stationary state within a hollow part of the roll body 2.

The roll body 2 includes a shell part 21 having a cylindrical shape, and a pair of journal parts 22 respectively disposed on both ends of the shell part 21. Each of the journal parts 22 includes a flange portion 221 to cover an end opening of the shell part 21, and a hollow drive shaft 222 formed integrally with the flange portion 221. The drive shafts 222 are respectively rotatably supported on blocks 51 and 52 with bearings 41 and 42, such as rolling bearings, interposed therebetween. The roll body 2 is designed to be rotated by a driving force applied from the outside by a rotation drive mechanism, such as a motor (not illustrated).

The shell part 21 of the roll body 2 is provided with a plurality of jacket chambers 21A that extend in a longitudinal direction (axial direction) and enclose a two-phase gas-liquid heating medium therein. The jacket chambers 21A are spaced apart from each other, for example, at equal intervals, in the entire circumferential direction. A surface temperature of the shell part 21 is made uniform by latent heat transfer of the two-phase gas-liquid heating medium enclosed within the jacket chambers 21A.

The induction heating mechanism 3 includes a cylindrical iron core 31 having a cylindrical shape, an induction coil 32 being wound on an outer circumferential surface of the cylindrical iron core 31, and support shafts 331 and 332 each supporting the cylindrical iron core 31 and the induction coil 32. The support shafts 331 and 332 are respectively disposed on both ends of the cylindrical iron core 31. The support shafts 331 and 332 are individually inserted into the drive shaft 222 and are respectively rotatably supported on the drive shaft 222 with bearings 61 and 62, such as rolling bearings, interposed therebetween. Thus, the induction heating mechanism 3 is held in a stationary state with respect to the roll body 2 in the inside of the roll body 2 being rotated. A lead wire L1 is coupled to the induction coil 32, and an AC power source (not illustrated) for applying an AC voltage is coupled to the lead wire L1 with a power regulating apparatus (not illustrated) interposed therebetween.

With the induction heating mechanism 3, an alternating magnetic flux occurs upon application of the AC voltage to the induction coil 32, and the alternating magnetic flux passes through the shell part 21 of the roll body 2. An induced current occurs in the shell part 21 due to the passage of the alternating magnetic flux, and the shell part 21 generates Joule heat by the induced current.

The induction heated roll apparatus 100 of the present embodiment includes a cooling mechanism 7 that cools the roll body 2 and the induction heating mechanism 3 by generating a gas flow in a clearance part X1 between the roll body 2 and the induction heating mechanism 3. The gas that is a cooling medium in the present embodiment is air that is atmospheric gas in an installation space of the roll body 2. Alternatively, the gas may be nitrogen gas or the like by changing the atmospheric gas into, for example, nitrogen gas or the like.

As illustrated in FIG. 1, the cooling mechanism 7 is designed to cool the roll body 2 and the induction heating mechanism 3 by introducing an external gas of the roll body 2 from one end in an axial direction of the clearance part X1 having an approximately cylindrical shape formed between the roll body 2 and the induction heating mechanism 3, while discharging the external gas from an opposite end in the axial direction of the clearance part X1 to the outside. As used herein, the axial direction is a crosswise direction on a paper surface as indicated by arrows in FIG. 1.

Specifically, the cooling mechanism 7 includes a suction port 71, an exhaust port 72, and a suction mechanism 73. The suction port 71 is disposed on one axial end side of the roll body 2 and communicated with the clearance part X1. The exhaust port 72 is disposed on the opposite axial end side of the roll body 2 and communicated with the clearance part X1. The suction mechanism 73 is coupled to the exhaust port 72 and designed to suck the gas in the clearance part X1 from the exhaust port 72.

Figure 2:
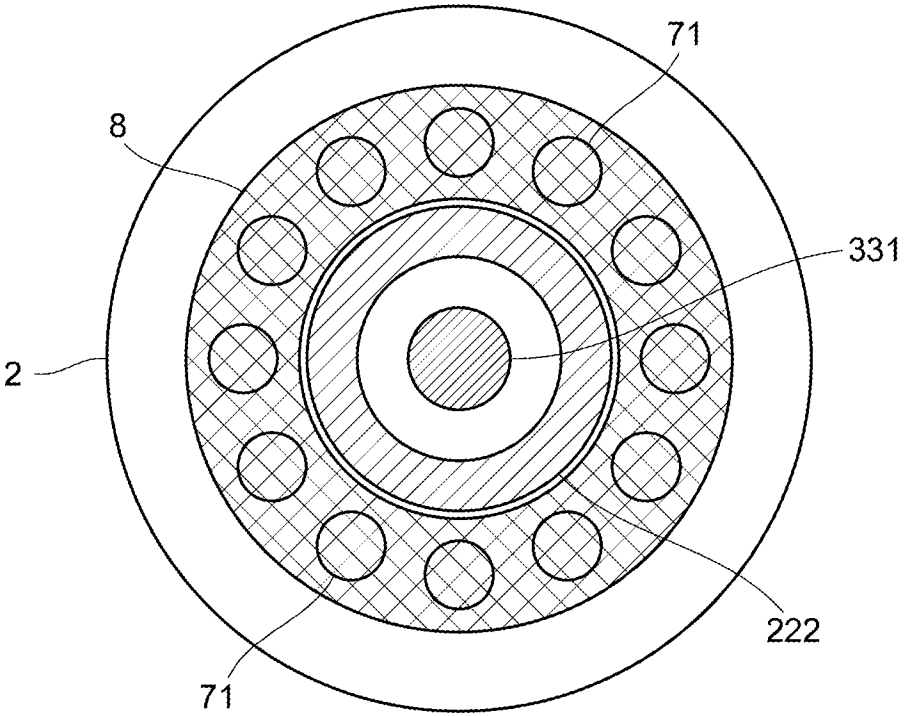
FIG. 2 is a sectional view taken along line A-A of FIG. 1, illustrating a configuration of a suction port in the first embodiment.

As illustrated in FIG. 2, a plurality of the suction ports 71 are disposed on a flange portion 221 in the journal part 22 on the one axial end side. The suction ports 71 are disposed, for example, at equal intervals, in a circumferential direction at the flange portion 22 on the one axial end side. Each of the suction ports 71 is composed of a through hole formed along an axial direction of the flange portion 221. An opening shape of the suction ports 71 in the present embodiment is a circular shape. Besides this, the opening shape may have different shapes, such as an elongated circular shape, an oval shape, a rectangular shape, and a polygonal shape. The suction port 71 is provided with a filter 8 for removing foreign matter in the gas to be sucked. Although the filter 8 in the present embodiment is an integrated one which closes the suction ports 71, the filter 8 may be disposed on each of the suction ports 71.

Figure 3:
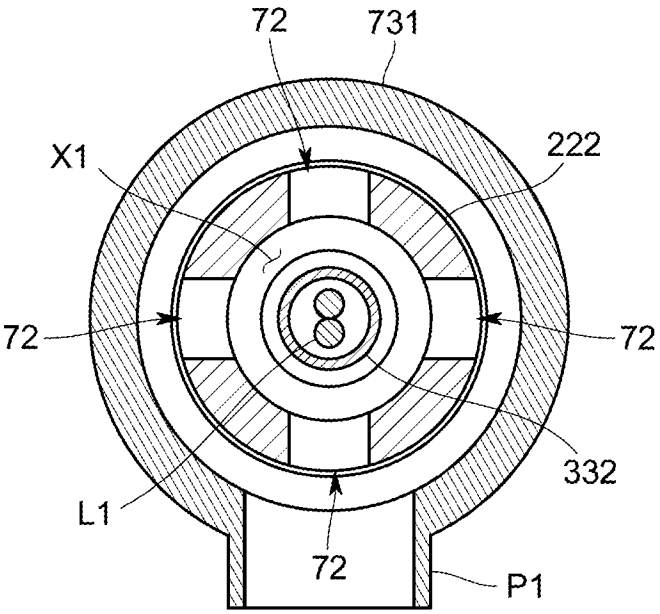
FIG. 3 is a sectional view taken along line B-B of FIG. 1, illustrating a configuration of an exhaust port in the first embodiment.

As illustrated in FIG. 3, a plurality of the exhaust ports 72 are disposed on an outer circumferential surface of the drive shaft 222 in the journal part 22 on the opposite axial end side. The exhaust ports 72 are disposed, for example, at equal intervals, in the circumferential direction in the drive shaft 222 on the opposite axial end side. Each of the exhaust ports 72 is composed of a through hole formed along a radial direction on a circumferential side wall of the drive shaft 222. An opening shape of the exhaust ports 72 in the present embodiment is a circular shape. Besides this, the opening shape may have different shapes, such as an elongated circular shape, an oval shape, a rectangular shape, and a polygonal shape. A bearing 62 is disposed axially further outside than the exhaust ports 72 in the drive shaft 222 on the opposite axial end side.

Figure 4:
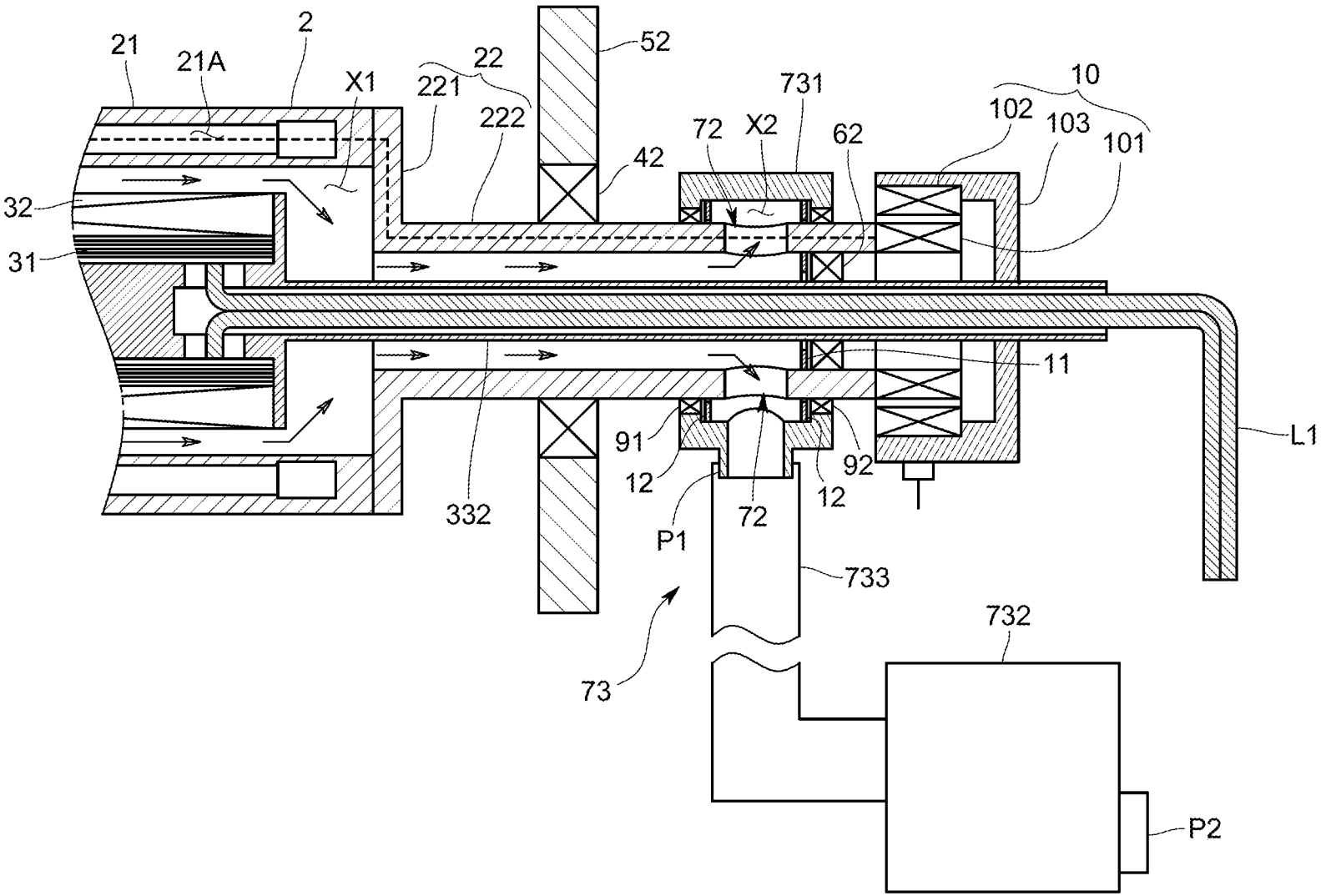
FIG. 4 is a sectional view illustrating a configuration of an opposite axial end side of a roll body in the first embodiment.

As particularly illustrated in FIG. 4, the suction mechanism 73 includes a cover body 731 that is a stationary body disposed so as to cover the exhaust ports 72 on the stationary side, and a suction device 732 coupled to the cover body 731 and designed to suck the gas in the clearance X1 from the exhaust ports 72. The cover body 731 and the suction device 732 are coupled to each other by connecting piping (connecting duct) 733 in the present embodiment.

The cover body 731 has an approximately cylindrical shape and is disposed outside the outer circumferential surface of the drive shaft 222 having the exhaust ports 72 formed therein. An inner circumferential surface of the cover body 731 and the outer circumferential surface of the drive shaft 222 form an exhaust space X2 for outwardly exhausting the gas exhausted from the exhaust ports 72. The cover body 731 is provided with a connection port P1 designed to connect the connecting duct 733, and the exhaust space X2 is communicated with the connection port P1. The cover body 731 is disposed through two bearings 91 and 92 on the drive shaft 222 so as to cover the exhaust ports 72. The bearings 91 and 92 are disposed so as to axially hold the exhaust ports 72 therebetween. The cover body 731 is disposed axially further outside than the block 52 in the drive shaft 222. The cover body 731 is secured to the stationary side so as not to rotate together with the drive shaft 222.

A rotary transformer 10 is disposed axially outside the drive shaft 222 provided with the cover body 731. The rotary transformer 10 transmits a detection signal of a temperature sensor T1 (refer to FIG. 1) to detect a temperature of the shell part 21 of the roll body 2, to a controller on the stationary side. The rotary transformer 10 includes a rotor 101 disposed on the drive shaft 222 of the journal part 22, and a stator 102 disposed around the rotor 101. The stator 102 is disposed in a stator housing 103 having a cylindrical shape.

The suction device 732 is designed to suck the gas in the clearance part X1 from the connection port P1 of the cover body 731 with the exhaust space X2 interposed therebetween. The suction device 732 is, for example, a motor fan, a blower, or a suction pump. The suction device 732 is disposed on the stationary side. An exhaust duct (not illustrated) is coupled to the exhaust port P2 of the suction device 732. The exhaust port P2 in the exhaust duct is disposed in, for example, an external space (for example, outdoors) being different from the installation space of the induction heated roll apparatus 100. The suction device 732 may be disposed in the external space, and the suction device 732 disposed in the external space and the connection port P1 of the cover body 731 may be coupled to each other by the connecting duct 733. The suction device 732 is designed so that a suction force is changeable by changing, for example, the number of revolutions. This makes it possible to adjust a flow rate of the gas flowing through the clearance part X1. Alternatively, a flow rate adjustment mechanism, such as a flow rate adjustment valve, may be disposed in the connecting duct.

When suction is started by the suction device 732 in the above configuration, the gas in the clearance part X1 is sucked from the exhaust port 72, and external gas around the roll body 2 is sucked from the suction ports 71 into the clearance part X1. The gas sucked from the suction ports 71 flows through the interior of the clearance part X1 and is then exhausted from the exhaust ports 72. Because the bearing 62 is located axially further outside than the exhaust ports 72, most of the high-temperature gas is exhausted from the exhaust ports 72 before coming into contact with the bearing 62, thus making it possible to prevent the bearing 62 from being positively subjected to the high-temperature gas.

A shielding structure 11, such as a shielding plate, is disposed between the bearing 62 and the exhaust ports 72 on the opposite axial end side. The shielding structure 11 makes it difficult for the high-temperature gas to come into contact with the bearing 62 on the opposite axial end side. It is also possible to prevent the external gas from being sucked from the bearing 62 because ventilation resistance on the bearing 62 side is increased.

Similarly, a shielding structure 12, such as a shield plate, is disposed inside the bearings 91 and 92 disposed between the cover body 731 and the drive shaft 222. The shielding structure 12 makes it difficult for the high-temperature gas to come into contact with the bearings 91 and 92. It is also possible to prevent the external gas from being sucked from the bearings 91 and 92.

Furthermore, in the present embodiment, the following treatments are applied to portions with which the external gas sucked from the suction ports 71 comes into contact. That is, an outer circumferential surface of an induction coil 32 with which the external gas comes into contact is coated with a heat-resistant insulating varnish, such as a polyimide-based, silicone-based, or epoxy-based one. Specifically, the heat-resistant insulating varnish is applied to the outer circumferential surface of the induction coil 32. An inner surface of the roll body 2 with which the external gas comes into contact is coated with a heat-resistant material. Specifically, a heat-resistant paint or an antirust paint is applied to, or a plating process for antirust is applied to the inner surface of the roll body 2.

Effect of First Embodiment

With the induction heated roll apparatus 100 thus configured, the suction mechanism 73 is coupled to the exhaust ports 72 disposed on the opposite axial end side of the roll body 2. By sucking the gas from the exhaust ports 72, the external gas is sucked from the suction ports 71 disposed on the one axial end side of the roll body 2 and flows through the clearance part X1 between the roll body 2 and the induction heating mechanism 3. Here, the clearance part X1 between the roll body 2 and the induction heating mechanism 3 has the approximately cylindrical shape, so that the external gas sucked from the suction ports 71 flows uniformly in the circumferential direction. It is therefore possible to uniformly cool the roll body 2 and the induction heating mechanism 3. Here, since the gas warmed by flowing through the clearance part X1 is actively sucked by the suction port 73 and exhausted, the roll body 2 and/or the induction heating mechanism 3 can be cooled more evenly. Additionally, the circumferential structure of the roll body 2 for the purpose of obtaining the major effect of uniformly cooling the roll body 2 needs only to dispose the suction mechanism 73 on the opposite axial end side of the roll body 2. Hence, the configuration around the roll body 2 does not become complicated.

Besides the above, with the present embodiment, the high-temperature gas is exhausted to an appropriate place, such as outdoors, so that no high-temperature gas is exhausted into the installation space of the roll body 2, by disposing the exhaust duct in the suction mechanism 73. This not only prevents the high-temperature gas from threatening the safety of the operator, but also prevents adverse effects on the continuous heat treatment process of the continuous material.

Meanwhile, an investigation was conducted on temperature drop characteristics of the roll body due to a difference in air volume (a flow rate of air exhausted from the exhaust ports, namely, a flow velocity of the air in the clearance part X1). The roll body has a diameter of 250 mm and an axial length of 1400 mm. An ambient temperature was 20° C., and a cooling start temperature of the roll body was 200° C. A surface temperature of the roll body was measured when the roll body was cooled in a state in which the number of revolutions of the roll body was set to 90 rpm. Time elapsed until the surface temperature of the roll body was lowered to 30° C. was measured by setting the air volume to 7 $m^3$/min, 4 $m^3$/min, 1 $m^3$/min, and natural cooling (0 $m^3$/min).

Figure 5:
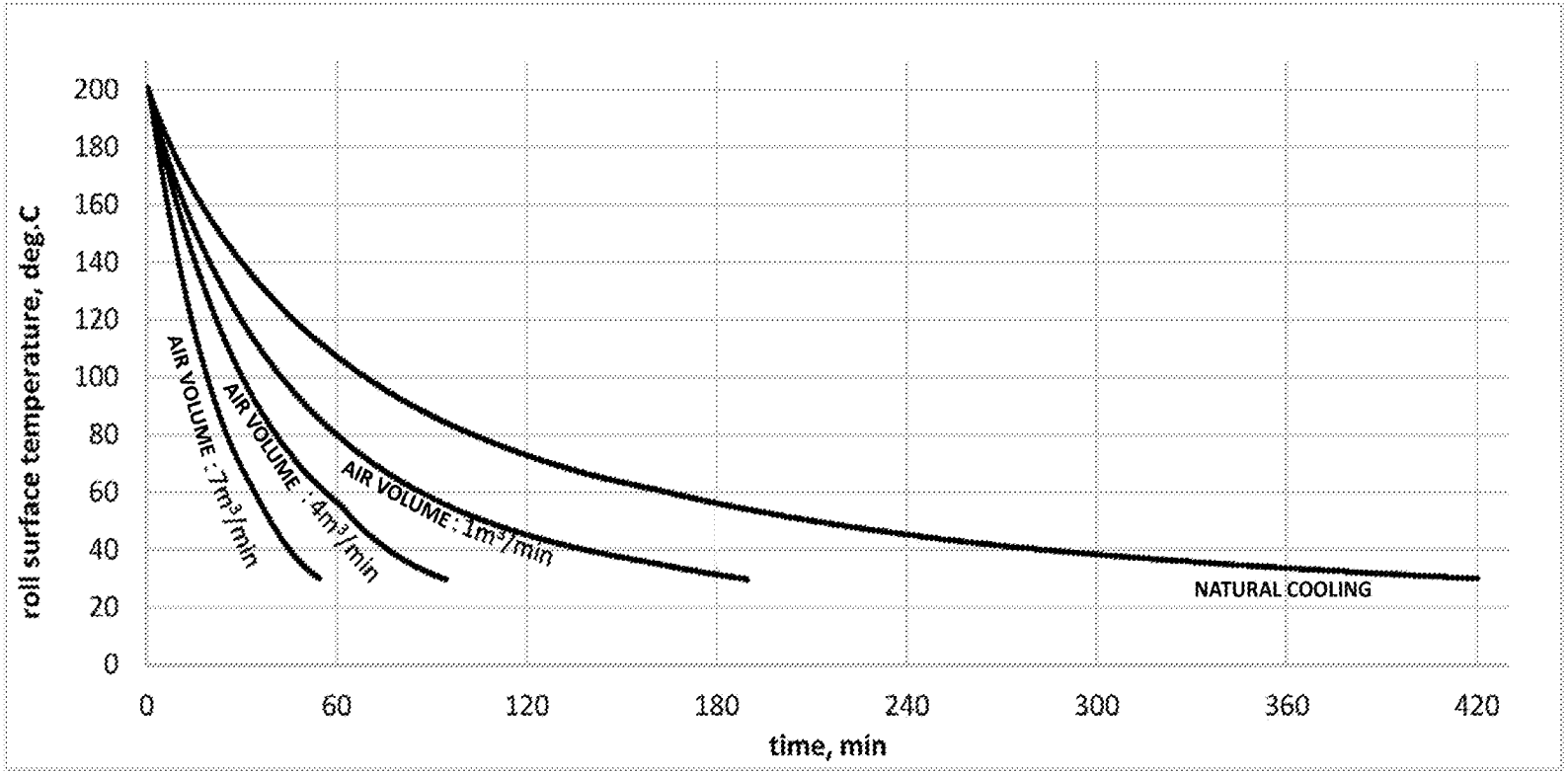
FIG. 5 is a graph indicating temperature drop characteristics of the roll body due to a difference in air volume.

The results are presented in FIG. 5. Although the natural cooling needs 420 minutes or more, the cooling time decreases with increasing the air volume, and the cooling time is less than 60 minutes when the air volume is 7 $m^3$/min, as presented in FIG. 5.

A load having a higher temperature than a necessary operating temperature may enter the roll body 2 (heated roll). Therefore, a roll temperature may increase even when an electric input is discontinued. In this case, it is difficult to make high-precision temperature control only by cooling due to the gas flow. Hence, there is a method of precisely controlling to a desired temperature by carrying out heat extraction slightly exceeding the heat input of the load, and then inputting only an amount of heat corresponding to an excess thereof by induction heating. The heat control by cooling under flow volume adjustment as described above is effective for making this control.

Even during cooling, the uniformity of temperature distribution in the shell part 21 of the roll body 2 is extremely important when the load operation is being carried out. The shell part 21 of the roll body 2 includes the jacket chambers 21A enclosing the two-phase gas-liquid heating medium therein. It is therefore possible to improve temperature uniformity in the axial direction of the shell part 21 of the roll body 2 during the cooling operation.

Moreover, the suction ports 71 are disposed at the journal part 22 on the axial one end side. It is therefore possible to ensure mechanical strength of the journal part 22 and also uniformly suck the gas in the circumferential direction of the clearance part X1 while reducing suction resistance.

Second Embodiment

An induction heated roll apparatus in a second embodiment is described below. Members identical or corresponding to those in the first embodiment are identified by the same reference numerals.

The induction heated roll apparatus 100 of the second embodiment is mainly different from the first embodiment in support form of support shafts 331 and 332 of an induction heating mechanism 3.

Figure 6:
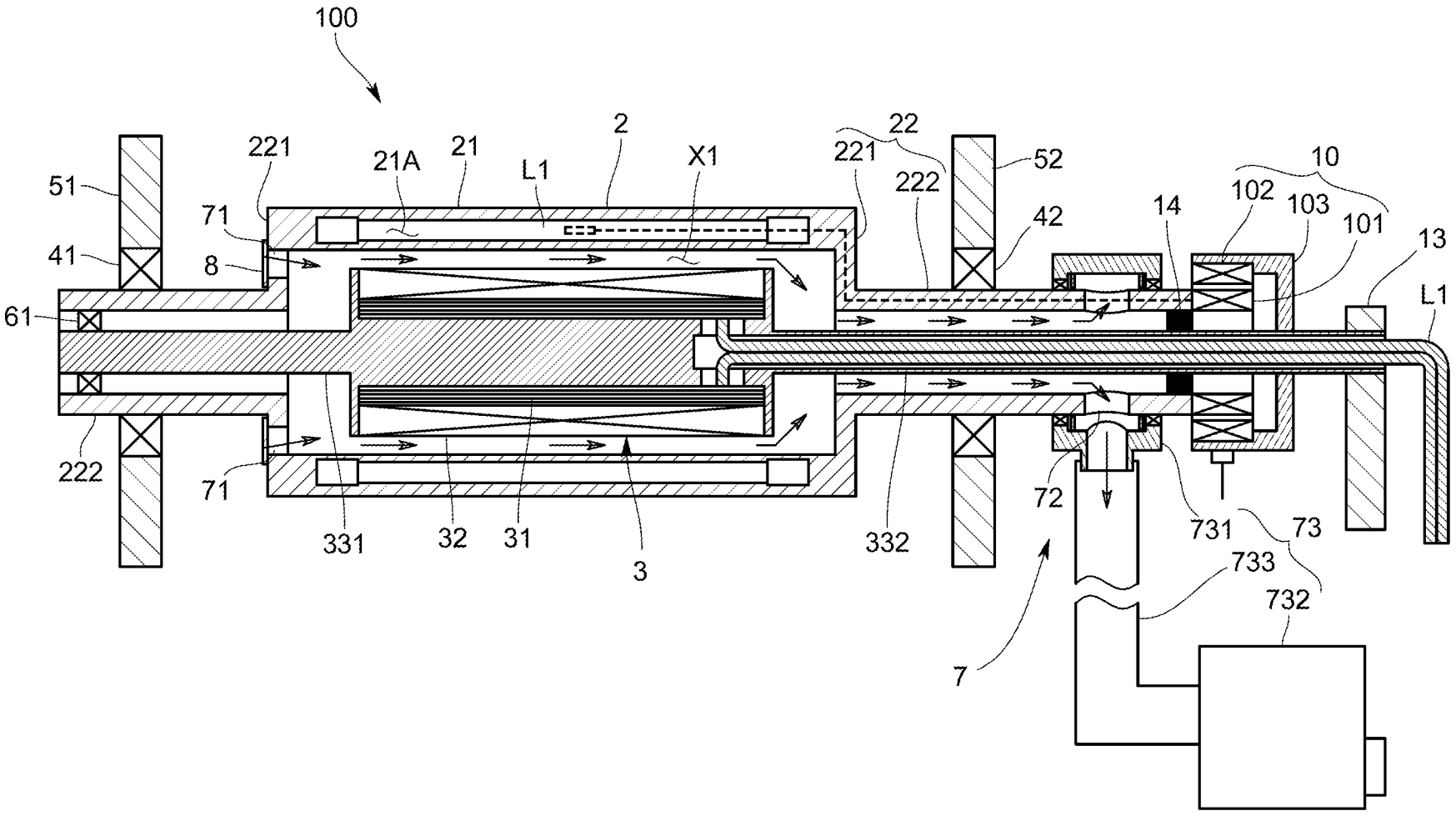
FIG. 6 is a sectional view illustrating a configuration of an opposite axial end side of a roll body in a second embodiment.

Specifically, in the induction heated roll apparatus 100, as illustrated in FIG. 6, the support shaft 331 on one axial end side is rotatably supported on a drive shaft 222 on the one axial end side with a bearing 61, such as a rolling bearing, interposed therebetween. The support shaft 332 on the opposite axial end side extends outward from the drive shaft 222 on the opposite axial end side and is secured to a member (support shaft block) 13 disposed on a stationary side.

When suction is carried out from exhaust ports 72 by a suction mechanism 73 in the above configuration, not only the gas in a clearance part X1 between a roll body 2 and the induction heating mechanism 3 is sucked, but also the external gas may be sucked from a clearance between the drive shaft 222 and the support shaft 332 on the opposite axial end side, and from a rotary transformer 10. Therefore, a rotary seal 14 is disposed between an inner circumferential surface of the drive shaft 22 and an outer circumferential surface of the support shaft 332 in the present embodiment. Alternatively, the rotary seal 14 may be disposed between an inner circumferential surface of the stator housing 103 of the rotary transformer 10 and an outer circumferential surface of the drive shaft 222.

When suction is started by a suction device 732 in the above configuration, the gas in the clearance part X1 is sucked from exhaust ports 72, and the gas around the roll body 2 is sucked from suction ports 71 into the clearance part X1. On this occasion, because the rotary seal 14 is disposed closer to the opposite axial end side than the exhaust ports 72, it is possible to prevent the external gas from being sucked from the opposite axial end side. The gas sucked from the suction ports 71 flows through the interior of the clearance part X1 and is then exhausted from the exhaust ports 72. Because any bearing (the bearing 62 in the foregoing embodiment) is not disposed on the opposite axial end side in the interior of the roll body 2, no high-temperature gas comes into contact with the bearing.

Effect of Second Embodiment

In addition to the effect of the first embodiment, the induction heated roll apparatus 100 thus configured produces the following effect. That is, the support shaft 332 on the opposite axial end side is supported on a block 13 on the stationary side. Therefore, the bearing that can be subjected to the high-temperature gas is eliminated to prevent damage to the bearing due to the high-temperature gas, thereby preventing corotation of an induction coil 32 and the roll body 2.

Third Embodiment

An induction heated roll apparatus in a third embodiment is described below. Members identical or corresponding to those in the first and second embodiments are identified by the same reference numerals.

Figure 7:
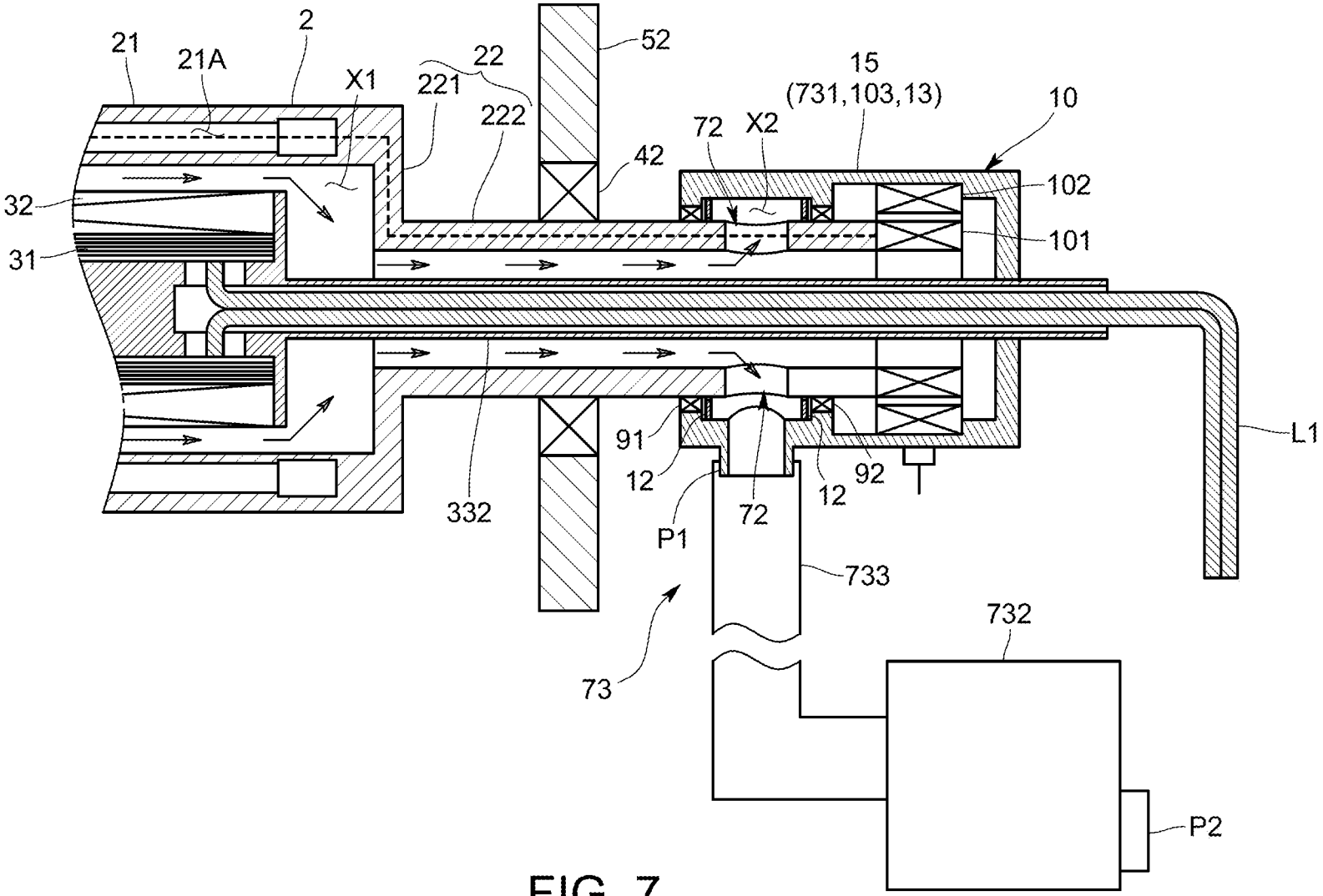
FIG. 7 is a sectional view illustrating a configuration of an opposite axial end side of a roll body in a third embodiment.

As illustrated in FIG. 7, the induction heated roll apparatus 100 of the third embodiment is different from the second embodiment in that at least a cover body 731 and a stator housing 103 of a rotary transformer 10 are integrally formed together. FIG. 7 illustrates an embodiment in which a support shaft block 13 is also integrally formed in addition to the cover body 731 and the stator housing 103.

Specifically, in the induction heated roll apparatus 100, the cover body 731, the stator housing 103, and the support shaft block 13 are made of a common cylindrical member 15 that is a stationary body. A side circumferential wall of the cylindrical member 15 is disposed on a drive shaft 222 with two bearings 91 and 92 interposed therebetween. Space between the two bearings 91 and 92 serves as an exhaust space X2. A connection port P1 designed to connect a suction device 732 is disposed between the two bearings 91 and 92 on the side circumferential wall. A stator 102 of a rotary transformer 10 is disposed at a position opposed to a rotor 101 of the rotary transformer 10 on an inner circumferential surface of the side circumferential wall. A support shaft 332 extends through a bottom wall of the cylindrical member 15, and the support shaft 332 is secured to the bottom wall. "Bottom" here refers to the ends of a closed cylindrical shape. The cylindrical member 15 is secured to a stationary side by a member (not illustrated). The member on the stationary side is designed to prevent rotation of the cylindrical member 15 and axially slidably support the roll body 2 and the like in order to allow their thermal elongation.

Effect of Third Embodiment

In addition to the effects of the first and second embodiments, the induction heated roll apparatus 100 thus configured is capable of simplifying the configuration on the opposite axial end side of the roll body 2 and decreasing the number of components because the cover body 731, the stator housing 103, and the support shaft block 13 are made of the common cylindrical member 15.

Other Modified Embodiments

The present invention is not limited to the foregoing embodiments.

Figure 8:
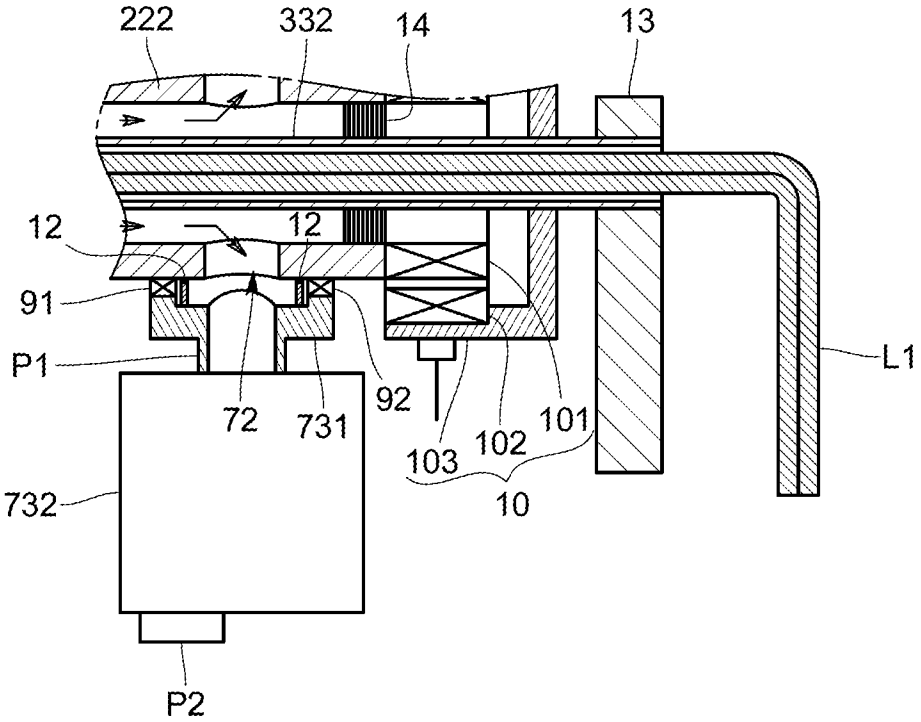
FIG. 8 is a sectional view schematically illustrating one modification of a suction mechanism.

For example, as illustrated in FIG. 8, the suction device 732 may be directly attached to the connection port P1 of the cover body 731 (or the cylindrical member 15) without interposing the connection duct therebetween.

In this case, a gas flow amplifier designed to receive a compressed gas from a compressed gas source and suck the gas from an exhaust port may be used as the suction device 732. With this configuration, there is no need to separately prepare, for example, a ventilator or a blower when the compressed gas source exists at an installation location of the induction heated roll apparatus 100 in a factory or the like.

Although the cover body 731, the stator housing 103, and the support shaft block 13 are integrally formed together in the third embodiment, just the cover body 731 and the stator housing 103 may be integrally formed together. In this case, the support shaft 332 on the opposite axial end side is supported by the support shaft block 13. In the configuration of the first embodiment, the cover body 731 and the stator housing 103 may be integrally formed together.

Figure 9:
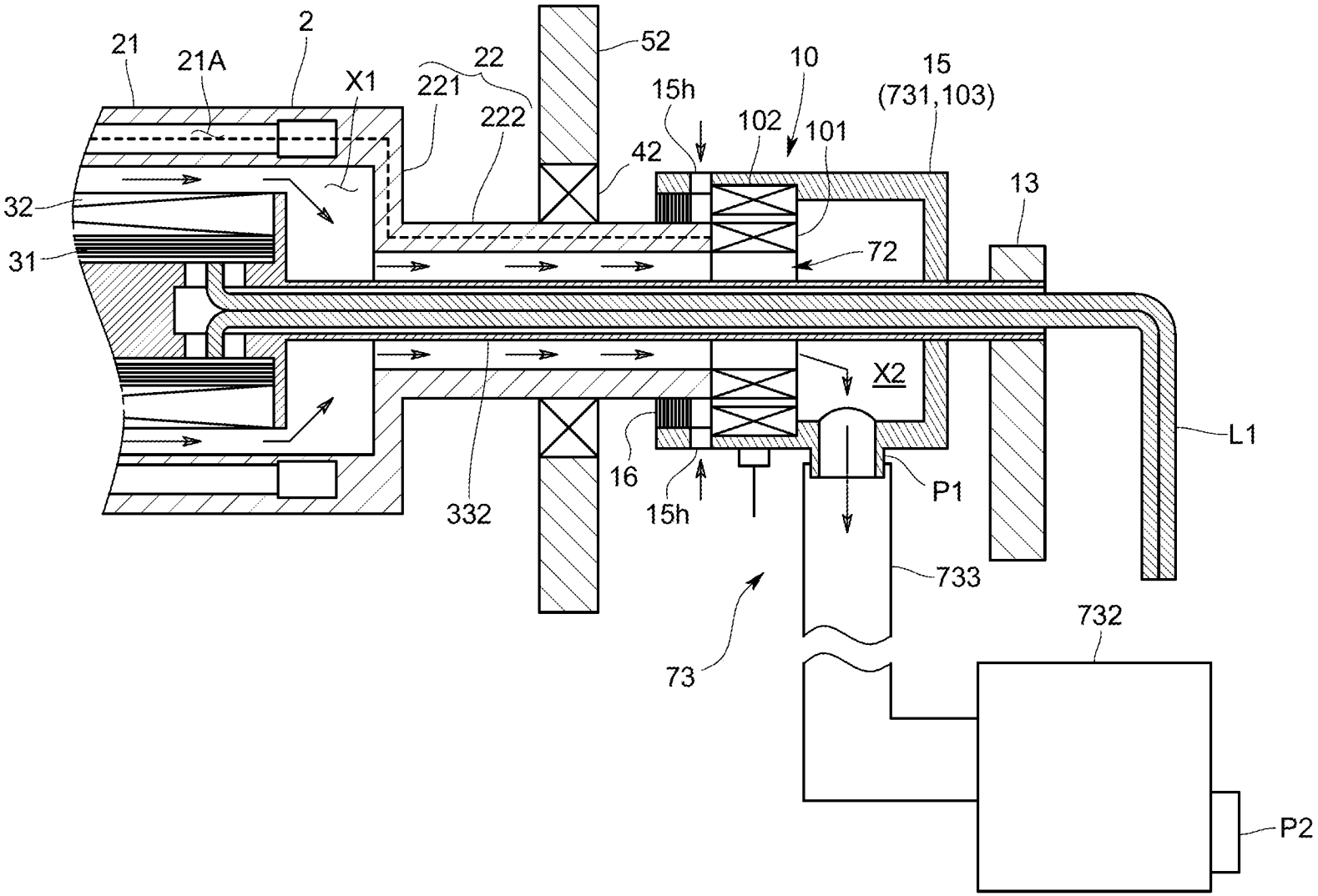
FIG. 9 is a sectional view schematically illustrating another modification of the suction mechanism.
Figure 10:
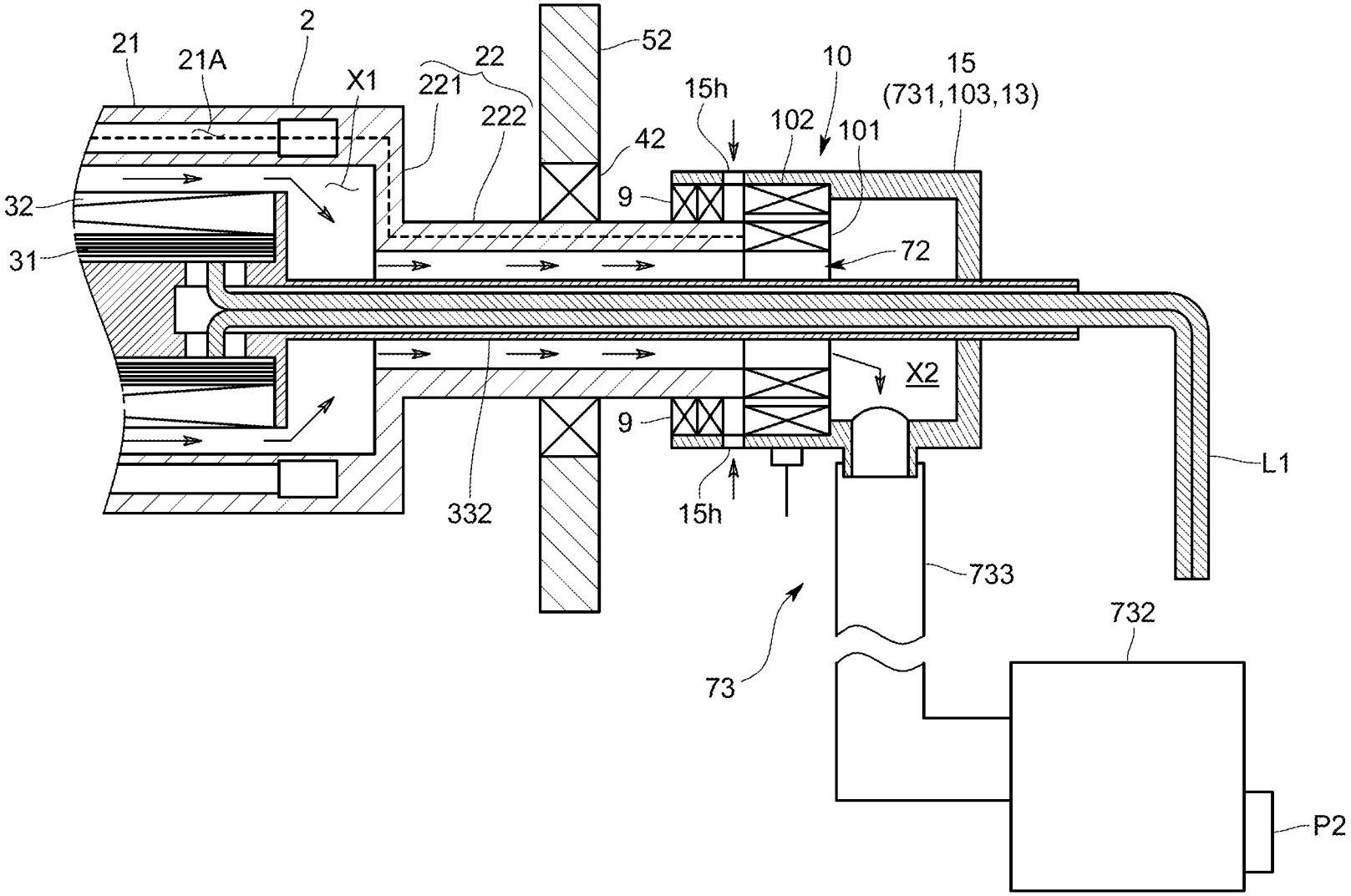
FIG. 10 is a sectional view schematically illustrating still another modification of the suction mechanism.

When the cover body 731 and the stator housing 103 or the like are integrally formed together, the connection port P1 may be disposed axially further outside (a bottom wall side) than the stator 102 of the rotary transformer 10 in the common cylindrical member 15 as illustrated in FIGS. 9 and 10. FIG. 9 illustrates a configuration that the support shaft 332 is supported by the support shaft block 13. FIG. 10 illustrates a configuration that the support shaft 332 is supported by the cylindrical member 15. Here, the exhaust ports 72 are composed of an annular space formed between the drive shaft 222 (or the rotor 101) and the support shaft 332 on the opposite axial end side.

In the configuration in FIG. 9, the external gas may be sucked from an opening of the cylindrical member 15, namely, the space between the rotor 101 and the stator 102. Therefore, a rotary seal 16 is preferably disposed closer to the opening than the stator 102 on the side circumferential wall of the cylindrical member 15. In both configurations in FIGS. 9 and 10, a through hole 15*h* designed to communicate with the outside is formed between the stator 102 and the rotary seal 16 or the bearing 9 on the side circumferential wall of the cylindrical member 15. An appropriate flow rate of gas is designed to be sucked from the through hole 15*h* so that the rotor 101 and the stator 102 are cooled to make them less likely to deteriorate. In FIG. 10, the bearing 9 is preferably provided with a shielding structure, such as a shielding plate, in order to prevent suction of the external gas from the bearing 9.

In each of the foregoing embodiments, the exhaust ports 72 are disposed on the outer circumferential surface of the drive shaft 222 of the journal part 22. The exhaust ports 72 may be disposed on the flange part 221 of the journal part 22 as in the case with the suction ports 71 in the foregoing embodiments. In this case, an annular cover body 731 is disposed so as to oppose to the flange part 221.

In each of the foregoing embodiments, the suction ports 71 are disposed at the flange part 221 of the journal part 22 on the one axial end side. Besides this, a variety of changes can be made if it is a position at which it is possible to supply the gas to one axial end side of the clearance part X1.

Figure 11:
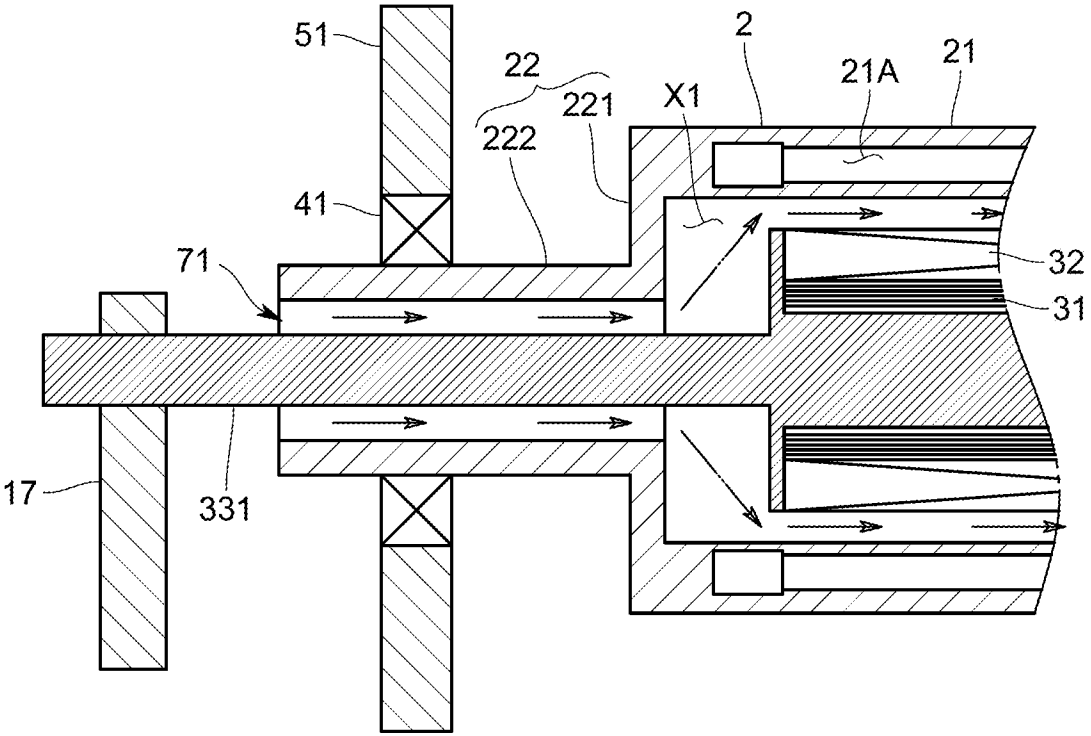
FIG. 11 is a sectional view schematically illustrating one modification of a suction port.

For example, as illustrated in FIG. 11, the support shaft 331 on the one axial end side may be supported on a block 17 disposed outside the roll body 2, and an annular space formed between the drive shaft 222 and the support shaft 331 on the one axial end side may be used as the suction port 71. Alternatively, the suction port 71 may be used together with a suction port disposed at another position. When a filter is attached to the suction portion 71, the filter needs to be disposed between a rotary part (the drive shaft 222) and a nonrotary part (the support shaft 331). Therefore, a clearance between an inner circumferential surface of the filter and an outer circumferential surface of the support shaft 331 needs not to exceed an allowable foreign matter size.

Figure 12:
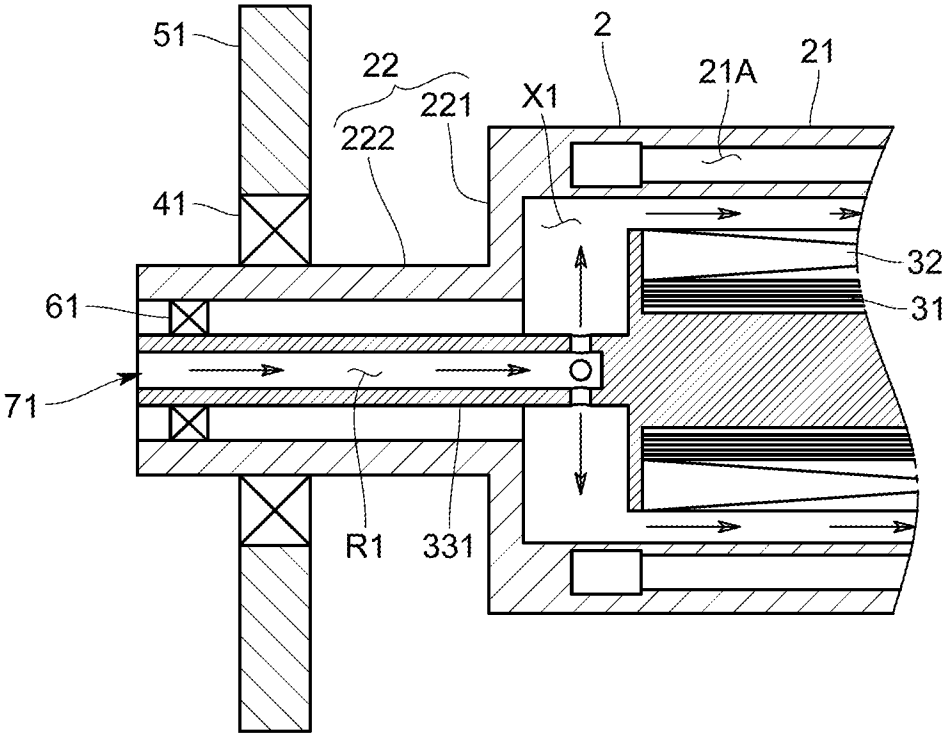
FIG. 12 is a sectional view schematically illustrating another modification of the suction port.

Alternatively, as illustrated in FIG. 12, an internal flow channel R1 may be coaxially formed inside the support shaft 331 and around the shaft, and the internal flow channel R1 may be branched radially on the induction coil 32 side of the support shaft 331 so as to be opened in the outer circumferential surface of the support shaft 331. In this case, the opening of the internal flow channel R1 in an axial end surface of the support shaft 331 serves as the suction port 71. The suction port 71 may be used together with a suction port disposed at another position.

Figure 13:
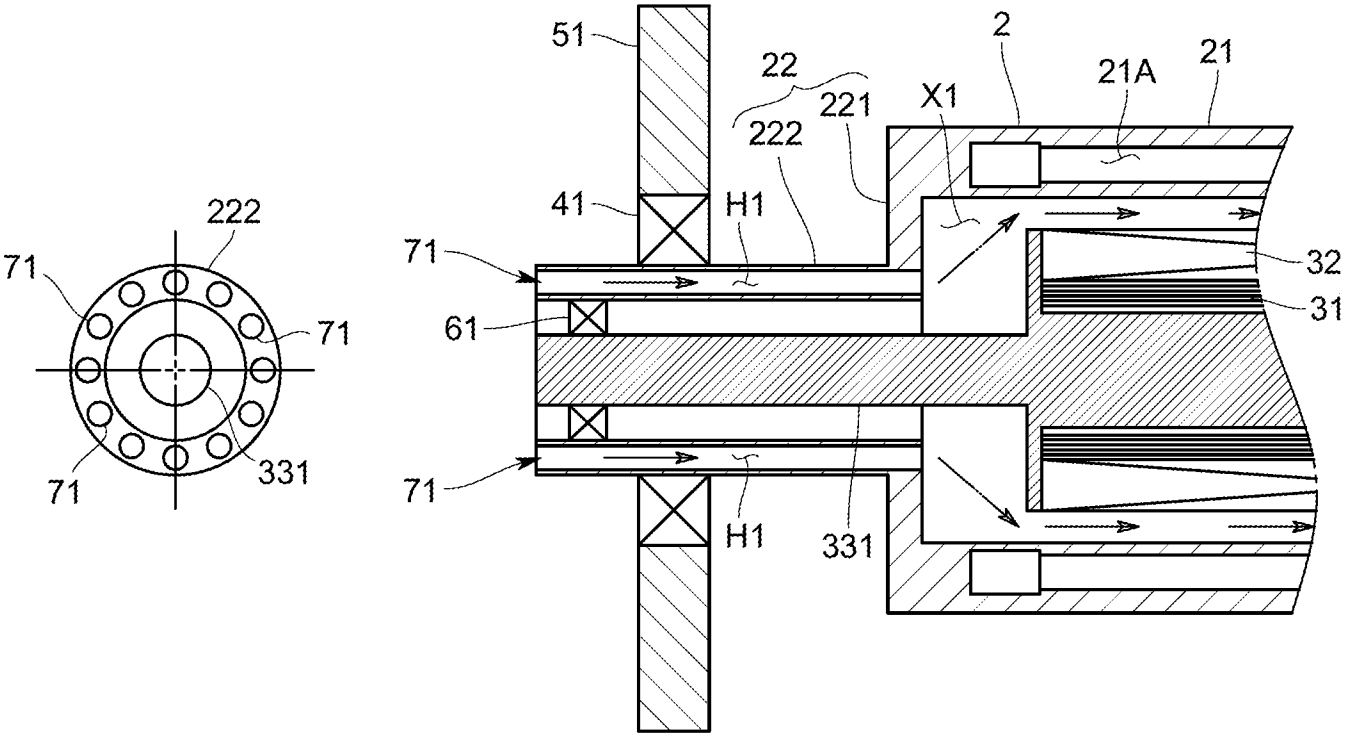
FIG. 13 is a sectional view schematically illustrating still another modification of the suction port.

Still alternatively, as illustrated in FIG. 13, a through hole H1 may be formed along an axial direction on the side circumferential wall of the drive shaft 222 on one axial end side. Preferably, a plurality of the through holes H1 are formed at equal intervals in a circumferential direction on the side circumferential wall. In this case, openings of the through holes H1 on an axial end surface of the drive shaft 222 serve as suction ports 71. The suction ports 71 may be used together with a suction port disposed at another position.

Figure 14:
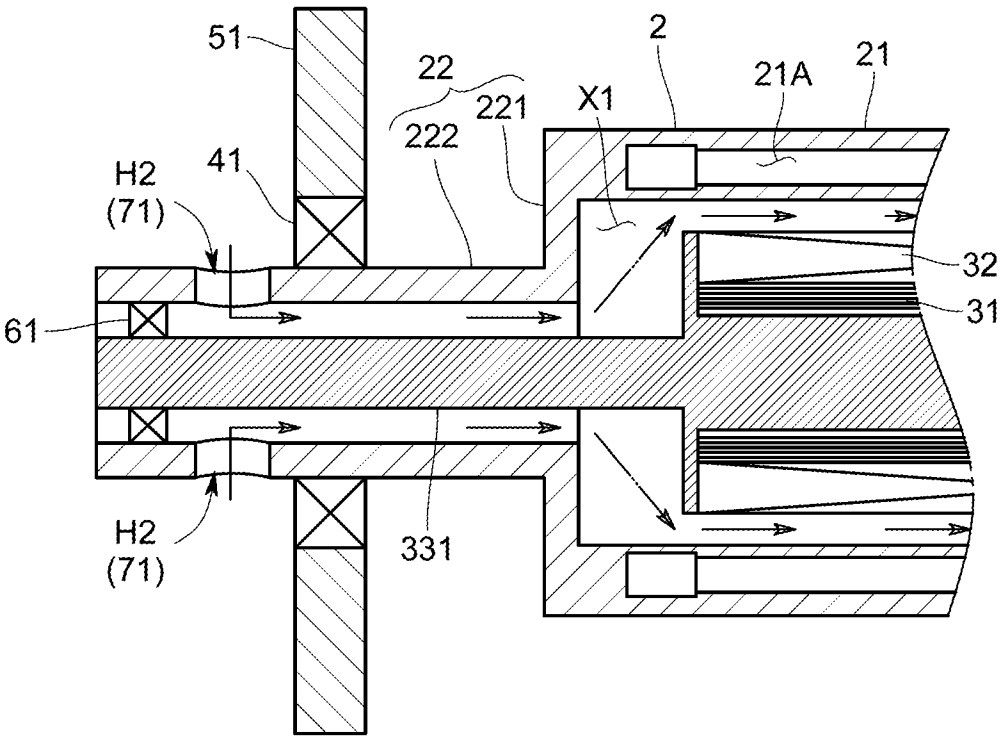
FIG. 14 is a sectional view schematically illustrating yet another modification of the suction port.

Moreover, as illustrated in FIG. 14, a through hole H2 may be formed along a radial direction on the side circumferential wall of the drive shaft 222 on one axial end side. Here, the through hole H2 is formed axially further inside than a bearing 61 on the one axial end side. In this case, a radially outside opening of the through hole H2 serves as a suction port 71. The suction port 71 may be used together with a suction port disposed at another position as needed.

Figure 15:
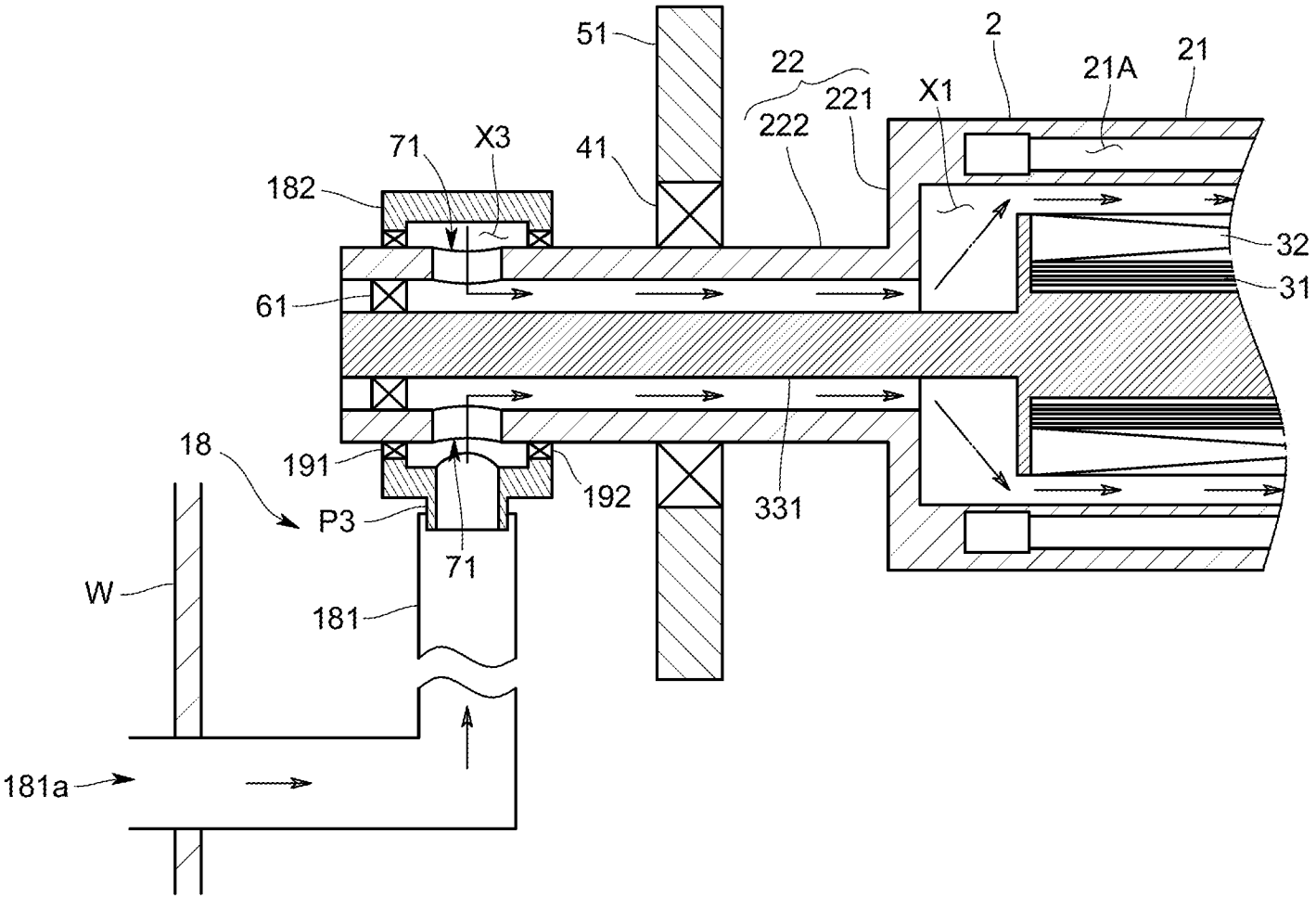
FIG. 15 is a sectional view schematically illustrating a supply mechanism in an induction heated roll apparatus in a modified embodiment.

When the induction heated roll apparatus 100 is installed in a harmful atmosphere containing a corrosive gas and a combustible gas, the induction heated roll apparatus 100 may further include a supply mechanism 18 designed to supply gas to the suction port 71 as illustrated in FIG. 15. This configuration is capable of eliminating the probability of causing a serious accident to happen due to the fact that the corrosive gas or the combustible gas is sucked into the roll body 2. The gas supplied may be an inert gas, such as nitrogen gas, besides air. Alternatively, air containing a mist may be supplied.

It is conceivable to configure the supply mechanism 18 so as to include supply piping 181 to supply the gas to the suction port 71, and a joint member 182 to connect the supply piping 181 and the suction port 71. The supply piping 181 is coupled to a connection port P3 disposed in the joint member 182. In the configuration in FIG. 15, the suction port 71 is disposed on the outer circumferential surface of the drive shaft 222, and a gas introduction port 181*a* of the supply piping 181 is disposed in an atmosphere separated from the harmful atmosphere by a wall W.

The joint member 182 has an approximately cylindrical shape disposed outside the outer circumferential surface of the drive shaft 222 provided with the suction port 71. An inner circumferential surface of the joint member 182 and the outer circumferential surface of the drive shaft 222 form an introduction space X3 designed to introduce the gas into the suction port 71. The joint member 182 is provided with a connection port P3 designed to connect the supply piping 181, and the introduction space X3 is communicated with the connection port P3. The joint member 182 is disposed on the drive shaft 222 so as to cover the suction port 71 by interposing therebetween two bearings 191 and 192 disposed so as to hold the suction port 71 therebetween in the axial direction. The joint member 182 is secured to the stationary side so as not to rotate together with the drive shaft 222. The bearing 61 and the bearings 191 and 192 are preferably provided with a shielding structure, such as a shielding plate, in order to avoid suction of the gas in the harmful atmosphere.

Figure 16:
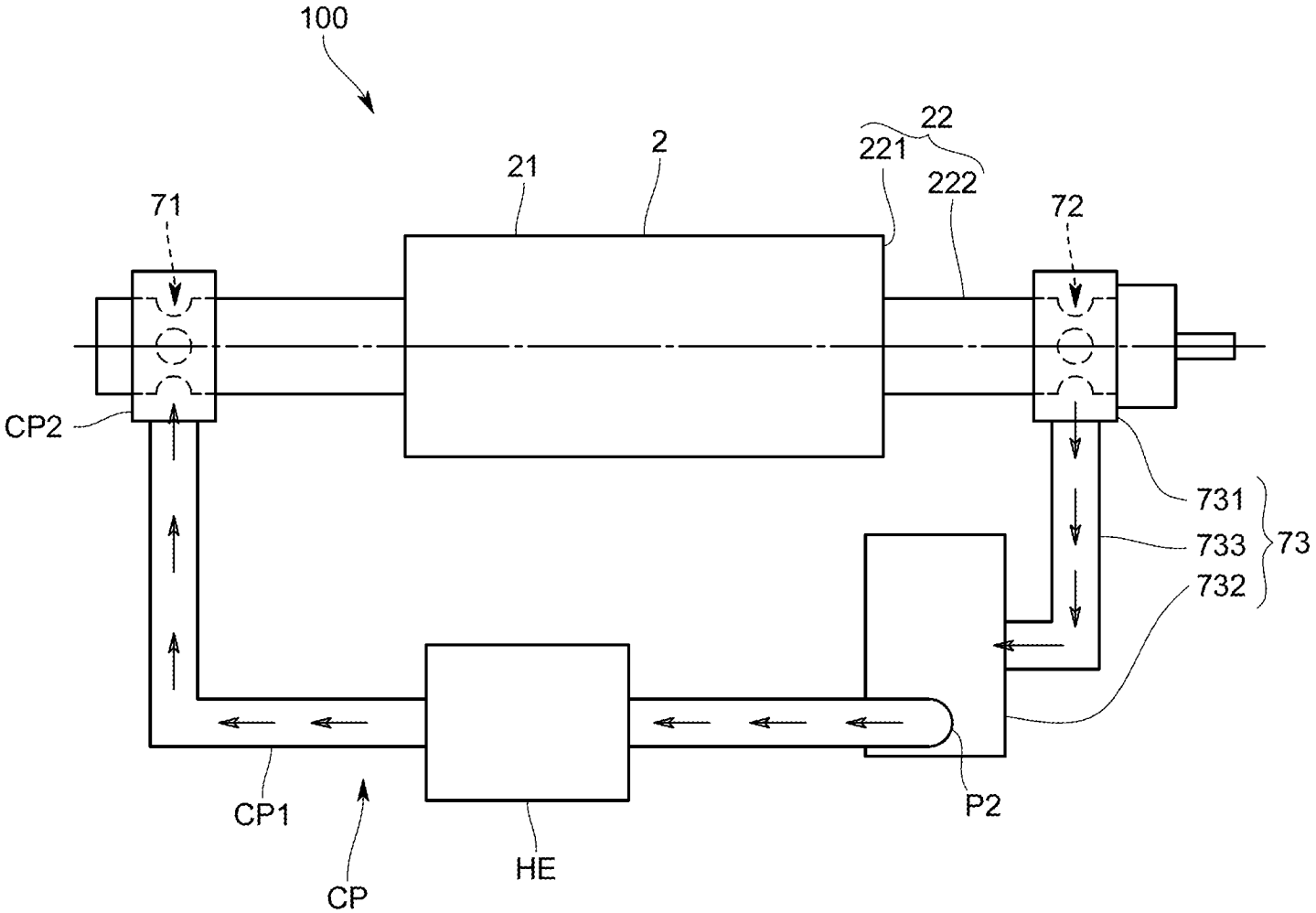
FIG. 16 is a diagram schematically illustrating a configuration of the induction heated roll apparatus in the modified embodiment.

Alternatively, the induction heated roll apparatus 100 may further include a circulating passage CP and a heat exchanger HE as illustrated in FIG. 16. The circulating passage CP is designed to permit communication between the suction port 71 and the exhaust port 72 outside of the roll body 2 so as to return the gas sucked from the exhaust port 72 by the suction device 732 to the suction port 71. The heat exchanger HE is disposed in the circulating passage CP and designed to cool the gas.

The circulating passage CP illustrated in FIG. 16 includes the suction mechanism 73 of the foregoing embodiment, and a connecting piping (connecting duct) CP1 to connect the exhaust port P2 in the suction mechanism 732 and the suction port 71 in the suction device 732. The connecting piping CP1 and the suction port 71 are coupled to each other by a cover body CP2 having the same structure as the cover body 731 used in a connection structure for the exhaust port 72 and the suction mechanism 73. The configuration having the above circulating passage CP is capable of reducing the influences of suction and exhaust.

Figure 17:
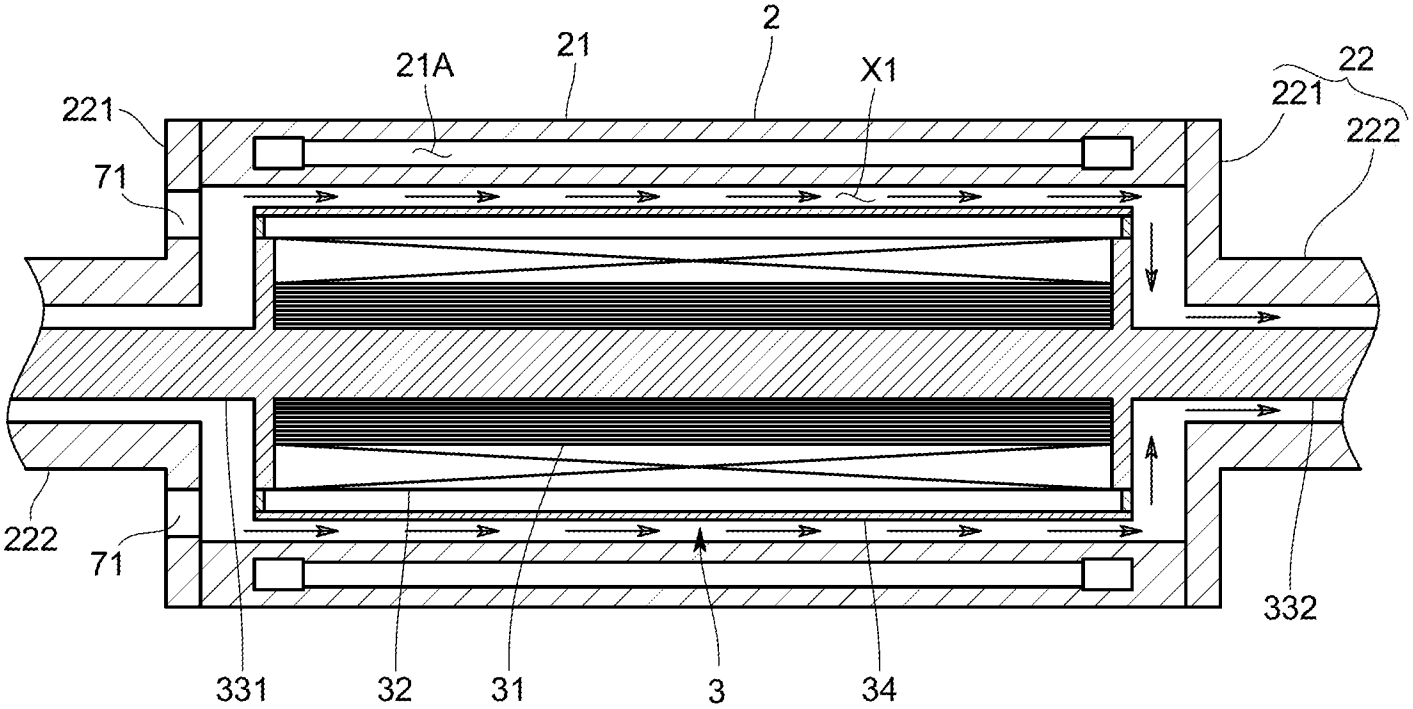
FIG. 17 is a sectional view illustrating one configuration of a roll body in the modified embodiment.

Further, in the induction heated roll apparatus 100, an insulating pipe 34 being smaller than inner circumferential diameter of the roll body 2 may be secured to the outer circumference of the induction heating mechanism 3, and the clearance part X1 may be formed between the roll body 2 and the insulating pipe 34 as illustrated in FIG. 17. The insulating pipe is disposed so as to cover the entirety of the induction coil 32 of the induction heating mechanism 3. The insulating pipe 34 is disposed separately from the induction coil 32 in an outer diameter direction. The clearance part X1 between the roll body 2 and the induction heating mechanism 3 can be reduced to increase a flow velocity of an air flow by the insulating pipe 34, thus improving cooling effect. If the insulating pipe 34 and the roll body 2 come in contact with each other, a serious accident is less likely to occur.

Figure 18:
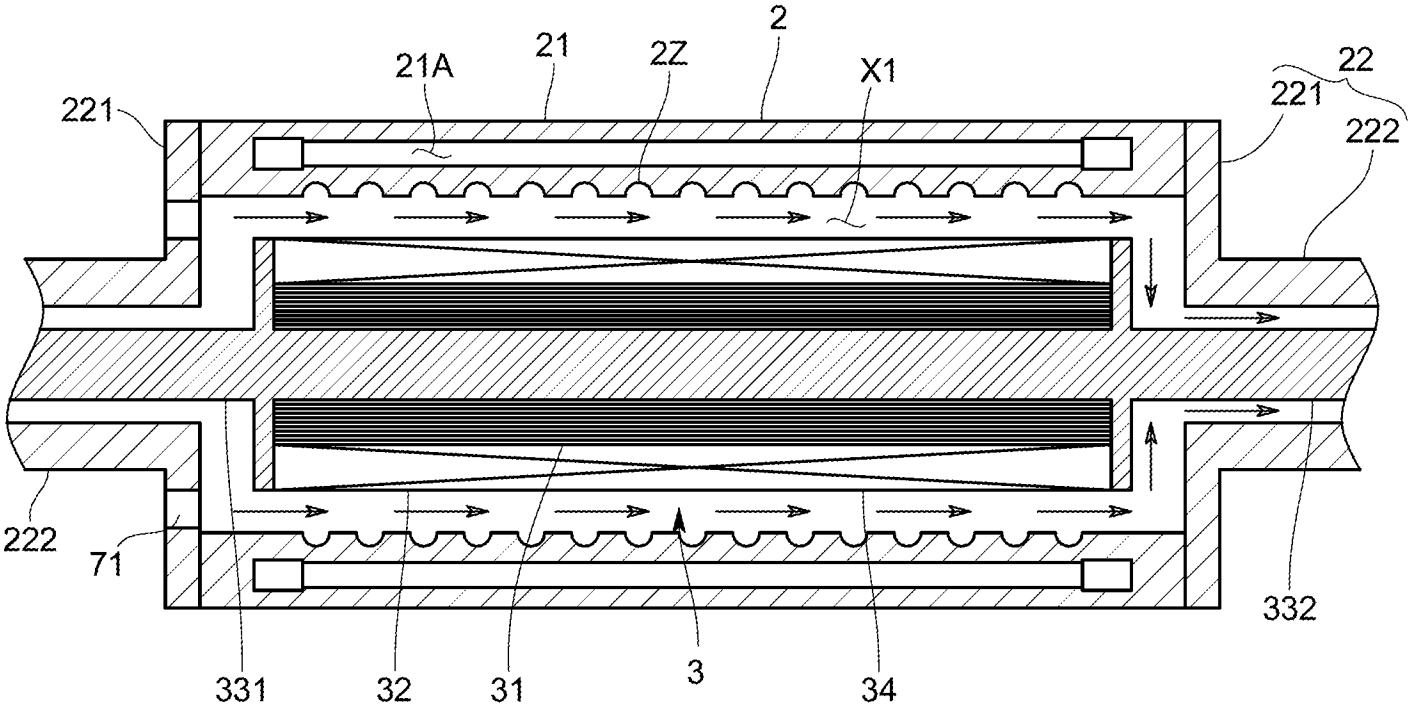
FIG. 18 is a sectional view illustrating another configuration of the roll body in the modified embodiment.

Furthermore, as illustrated in FIG. 18, a rugged structure 2Z is preferably formed on an inner surface of the roll body 2 in order that a heat transfer area on the inner surface of the roll body 2 is increased to enhance the cooling effect. Although the rugged structure 2Z is formed by forming recesses on the inner surface of the roll body 2 in FIG. 18, the rugged structure 2Z may be formed by forming protrusions on the inner surface. Because the inner surface of the roll body 2 serves as a heat generation part due to induction heating, the inner surface is preferably made into a regular shape in the circumferential and axial directions from the viewpoint of equalizing the amount of heat generation.

Although the cover body 731 and the cylindrical member 15 in the foregoing embodiments have the cylindrical shape, both may have, besides the cylindrical shape, any polygonal cylindrical shape, such as a rectangular cylinder, as long as it covers the outer circumference of the drive shaft 222.

Besides the above, it will be understood that the present invention is not limited to the foregoing embodiments, and various modifications may be made without departing from the spirit and scope of the present invention.

DESCRIPTION OF THE REFERENCE CHARACTERS

100 induction heated roll apparatus
2 roll body
21 shell part
21A jacket chamber
22 journal part
222 drive shaft
3 induction heating mechanism
31 induction coil
331, 332 support shaft
X1 clearance part
7 cooling mechanism
71 suction port
8 filter
72 exhaust port
73 suction mechanism
731 cover body (stationary body)
732 suction device
61, 62 bearing
91, 92 bearing
13 block (support shaft block)
15 cylindrical member (stationary body)
18 supply mechanism
181 supply piping
182 joint member

What is claimed is:

1. An induction heated roll apparatus comprising:
a roll body having a hollow part;
an induction coil disposed in the hollow part and designed to cause the roll body to be subjected to induction heating; and
a cooling mechanism designed to cool the roll body and/or the induction coil by generating a gas flow in a clearance part between the roll body and the induction coil,
wherein the cooling mechanism comprises:
a suction port disposed on one axial end side of the roll body and designed to communicate with the clearance part;
a plurality of exhaust ports disposed on an outer radial surface of a drive shaft at an opposite axial end side of the roll body and designed to communicate with the clearance part, or formed in a flange part of a journal part of the roll body and designed to communicate with the clearance part; and
a suction mechanism, including a motor fan, a blower, a gas flow amplifier or a pump, coupled to the plurality of exhaust ports and designed to suck gas in the clearance part from the plurality of exhaust ports,
wherein the plurality of exhaust ports are rotatably coupled to the suction mechanism.

2. The induction heated roll apparatus according to claim 1,
wherein a plurality of the suction ports are disposed near the journal part on the one axial end side.

3. The induction heated roll apparatus according to claim 2, wherein the suction ports are disposed at equal intervals in a circumferential direction at the journal part on the one axial end side.

4. The induction heated roll apparatus according to claim 1, wherein the suction port is provided with a filter for removing foreign matter in the gas to be sucked.

5. The induction heated roll apparatus according to claim 1, wherein the suction mechanism comprises a stationary body disposed on a stationary side so as to cover the plurality of exhaust ports, and a suction device coupled to the stationary body and designed to suck the gas in the clearance part from the plurality of exhaust ports.

6. The induction heated roll apparatus according to claim 5,
wherein the plurality of exhaust ports are disposed on an outer circumferential surface of the drive shaft on the opposite axial end side, and
wherein the stationary body is disposed on the drive shaft on the opposite axial end side so as to cover the plurality of exhaust ports with a bearing interposed therebetween.

7. The induction heated roll apparatus according to claim 5,
further comprising a support shaft to support the induction coil, and
wherein the stationary body is designed to support the opposite axial end side of the support shaft.

8. The induction heated roll apparatus according to claim 5, wherein the suction device is integrally disposed on the stationary body with no piping interposed therebetween.

9. The induction heated roll apparatus according to claim 8, wherein the suction device is a gas flow amplifier.

10. The induction heated roll apparatus according to claim 1,
further comprising a support shaft to support the induction coil,
wherein one axial end of the support shaft is supported on the roll body with a bearing interposed therebetween, and wherein an opposite axial end of the support shaft is supported on a member disposed on a stationary side.

11. The induction heated roll apparatus according to claim 1, further comprising a support shaft to support the induction coil, wherein the support shaft is supported through a bearing on each of both axial end sides of the roll body, and wherein the bearing disposed on the opposite axial end side of the roll body is disposed axially further outside than the plurality of exhaust ports.

12. The induction heated roll apparatus according to claim 1, further comprising:

a supply mechanism designed to supply the gas to the suction port, wherein the supply mechanism comprises supply piping to supply the gas to the suction port, and a joint member to connect the supply piping and the suction port.

13. The induction heated roll apparatus according to claim 1, further comprising:

a circulating passage designed to permit communication between the suction port and the plurality of exhaust ports outside of the roll body so as to return the gas sucked from the plurality of exhaust ports by the suction device to the suction port; and a heat exchanger disposed in the circulating passage and designed to cool the gas.

14. The induction heated roll apparatus according to claim 1, wherein the roll body comprises a jacket chamber enclosing a two-phase gas-liquid heating medium therein and extending in an axial direction.

15. The induction heated roll apparatus according to claim 1, wherein the cooling mechanism is designed to adjust a flow rate of the gas flowing through the clearance part.

16. The induction heated roll apparatus according to claim 1, wherein an outer circumferential surface of the induction coil of the induction heating mechanism is coated with an insulating varnish.

17. The induction heated roll apparatus according to claim 1, wherein an insulating pipe being smaller than an inner circumferential diameter of the roll body is secured to an outer circumference of the induction heating mechanism, and wherein the clearance part is formed between the roll body and the insulating pipe.

18. The induction heated roll apparatus according to claim 1, wherein an inner surface of the roll body is coated with an antirust material.

19. The induction heated roll apparatus according to claim 1, wherein a rugged structure is formed on an inner surface of the roll body.

* * * * *